United States Patent [19]

Peters

[11] 4,002,711

[45] Jan. 11, 1977

[54] METHOD FOR DRAWING POLYURETHANE FILAMENTS

[76] Inventor: Timothy V. Peters, Rte. 3, Box 193, Lebanon, N.J. 08833

[22] Filed: May 22, 1974

[21] Appl. No.: 472,185

Related U.S. Application Data

[63] Continuation of Ser. No. 126,129, March 19, 1971, abandoned.

[52] U.S. Cl. ..... 264/184; 264/210 F; 264/235; 264/290 R

[51] Int. Cl.[2] ..... D01D 5/06; D01D 5/12

[58] Field of Search ..... 264/184, 235, 290 R, 264/210 F, DIG. 77; 260/77.5 SP

[56] References Cited

UNITED STATES PATENTS

| | | | |
|---|---|---|---|
| 2,746,839 | 5/1956 | Terry et al. | 264/184 |
| 3,342,028 | 9/1967 | Matsubayashi et al. | 264/342 RE |
| 3,357,076 | 12/1967 | Greenwald et al. | 28/72 |
| 3,387,448 | 6/1968 | Lathem et al. | 57/152 |
| 3,441,639 | 4/1969 | Killen et al. | 260/77.5 SP |
| 3,476,850 | 11/1969 | Matsubayashi et al. | 264/184 |
| 3,679,631 | 7/1972 | Mayes | 264/184 |
| 3,679,633 | 7/1972 | Matsubayashi et al. | 264/240 R |
| 3,699,205 | 10/1972 | Peters | 264/184 |

*Primary Examiner*—Jay H. Woo
*Attorney, Agent, or Firm*—James E. Ryder

[57] ABSTRACT

In the method of this invention a substantially linear polyurethane filament is elongated a number of times its original length and heated at a temperature above its "fiber stick temperature" for a sufficient time so that the filament permanently retains that elongation and does not recover any substantial amount of the length to which it has been elongated.

7 Claims, 1 Drawing Figure

Figure 1:
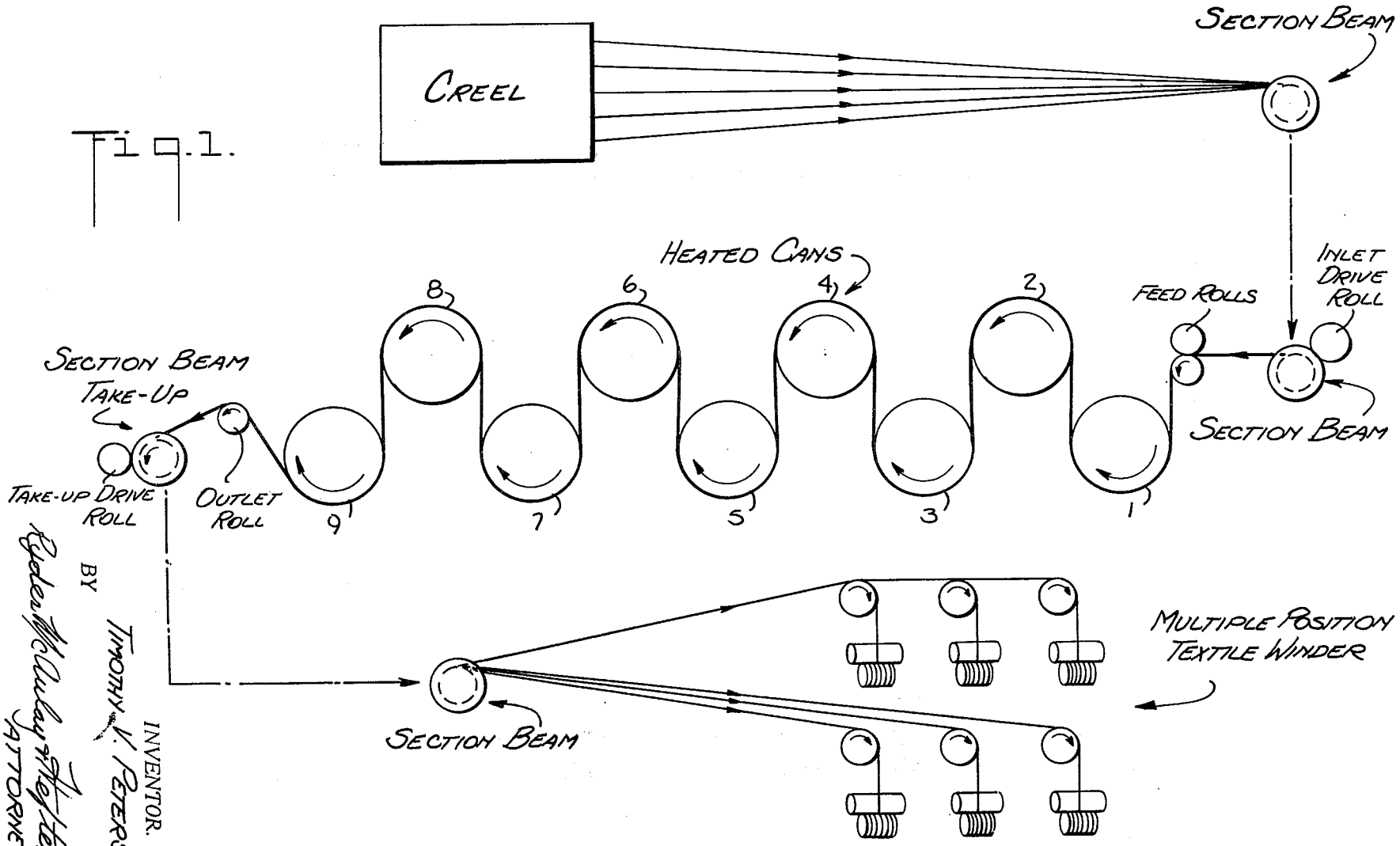

INVENTOR.
TIMOTHY V. PETERS
BY
Ryder McAulay & Hefter
ATTORNEYS

METHOD FOR DRAWING POLYURETHANE FILAMENTS

This is a continuation of application Ser. No. 126,129, filed Mar. 19, 1971, and now abandoned.

BACKGROUND

Polyurethane filaments, generically known as spandex, have become important commercially, and have become increasingly important recently in applications utilizing fine deniers, 70 denier or less. In the commercial production, for example by wet spinning, of polyurethane filaments a commercial unit has greater productivity by weight when it is used to produce a heaver denier such as one of 420 denier rather than when it is used to produce a finer denier, 70 denier or less. Also, mechanical handling of the finer deniers, because of their lightness, is more difficult, both as to handling by textile operators and otherwise in their transportation through the process, for example through a dryer. In addition, the energy requirements to operate a spinning line are substantially the same irrespective of the denier produced. As a result the cost per unit weight to produce a fine denier is higher than for a heavier denier.

SUMMARY OF THE INVENTION

This invention is a new method for permanently drawing a substantially linear elastomeric polyurethane filament. In carrying out the method, a substantially linear polyurethane filament is elongated a number of times its original length and heated at a temperature above its "fiber stick temperature" for a sufficient time so that the filament permanently retains that elongation and does not recover in any substantial amount any of the length to which it has been elongated. The method may then be repeated one or more times on the resulting drawn filament to give a final filament having whatever denier is desired. The drawn filament has properties comparable to the filament prior to treatment. The polyurethane filament prior to drawing may be one that has been produced by wet spinning, dry spinning or another method so long as it is substantially linear prior to drawing and not to any significant degree cross-linked as would ordinarily be the case of a polyurethane produced by chemical spinning. It is preferred that the starting substantially linear polyurethane filament be one produced by wet spinning such as the product described hereinafter in Example 1.

My new method permits a heavy denier substantially linear polyurethane filament to be first produced at a high productivity. The heavy denier filament may then be drawn according to my new method also at a high productivity to give a lower denier filament having properties comparable to the properties of the filament prior to drawing. My method therefore has great commercial importance. It permits production of a wide range of deniers while allowing the primary spinning line to be operated to produce a single heavy denier or a few heavy deniers. This not only reduces the energy cost per unit weight produced but also eliminates the costs of changing from denier to another in the primary spinning line. It also permits production of a heavy denier in the primary spinning line at a high productivity and with less difficulty of mechanical handling. It also reduces the necessity of maintaining an inventory of a number of deniers as a single heavy denier may be stored and then drawn according to my method to produce any denier required.

PREFERRED EMBODIMENTS AND EXAMPLES

As shown in the schematic diagram Examples FIG. 1, my method may be carried out by passing a number of identical, wet-spun elastomeric polyurethane filaments from a creel to form a beam. The beam is transferred to a second position (adjacent the inlet drive roll in FIG. 1), and the filaments are passed from the beam, controlled to feed the filaments at a specified speed by the inlet drive roll, to feed rolls (see FIG. 1). The feed rolls are set at a higher speed than the drive roll so as to elongate each filament several times its former length, preferably no more than two times. The filaments are then passed to a zone of heated cans (which may be heated by steam, hot oil, infrared or other means), operating at the same surface speed as the drive rolls, where each filament is heated to a temperature above the "fiber stick temperature" for a period of time. This time is of sufficient length so that the filament remains permanently deformed at that elongation and does not recover any substantial portion of the length to which it has been elongated. The filaments are then taken up on a take-up beam at the speed of the feed rolls, and the take-up beam is transferred to a holder (not shown) where the filaments are passed to a textile winder and wound up on packages ready for commercial use (see FIG. 1).

Alternatively, the filaments may be elongated as they pass from a heated can to the succeeding can in addition to the elongation produced between the drive roll and the feed rolls or all elongation may be introduced by the heated cans, eliminating the need for the feed rolls. Also, any means other than hot cans, for example a heated air space or a hot inert liquid medium, may be used to heat treat the elongated filaments. I prefer hot cans because they provide a high heat transfer rate, and allow good control of closely spaced filaments.

While the elongation of the filament prior to the heat treatment may be to any degree up to its breaking elongation, I prefer to elongate it no more than about two times its original length in any given step of heating and drawing. If a draw in excess of two times is desired, I have found it preferable to repeat the process by having another similar elongation and heating step. For example, the filament may be elongated up to two times its length between the inlet drive roll and the feed rolls (FIG. 1), heated on the first two cans then elongated a further two times between can 2 and can 3, heated by can 3 and 4 and similarly elongated and heated, if desired, by the remaining cans.

As described herein and in the Example the steps of elongation and of heat treatment are shown as discrete steps. However, in carrying out my method the elongation and heat treatment may be combined in a single step. Where a single treatment is given to a filament, I prefer to use discrete steps of elongation and of heating. Where a filament is elongated and heated several times, for ease of mechanical handling, it is preferable to elongate and heat the filament at the same time.

As used herein "fiber stick temperature" means, the temperature at which a fiber will stick to a heated brass block when held against the surface of the block for 5 seconds with a standard 200 gram brass weight, as determined by the following procedure.

The apparatus used to determine fiber stick temperature includes an electrically heated brass block (such as a Fisher-Johns melting point apparatus). No. 2 glass rods, five milimeter in diameter, are mounted in the same plane approximately 8 inches apart and 5 inches above the brass block. A standard 200 gram brass weight is placed on top of the block and the block gradually heated to a temperature near the sample's fiber stick temperature. A sample specimen approximately 18 inches in length is draped across the glass rods. A weight of approximately 1.5 miligrams per denier is attached to each end of the specimen to hold it in place. When the block reaches a temperature near the fiber stick temperature, the weight is lifted then immediately replaced with the filament specimen sandwiched between the heated block and the 200 gram weight. The weight is left in position for 5 seconds then lifted. If the fiber does not stick to the block, then the temperature is raised approximately 2° C, and the test is repeated using a new specimen. The same procedure is continued until the temperature is reached at which the filament just sticks to the heated block after the weight is removed. This is the "fiber stick temperature" of the filament.

In carrying out my method it is preferable to use a temperature as far in excess of the "fiber stick temperature" as possible without melting or decomposing the filament, as this, of course, permits a shorter residence time for heat treatment. Conversely, the lower the temperature of treatment the longer the residence time of the filament must be during heat treatment. The exact temperature and time of heat treatment required will vary depending on the particular urethane composition. It is preferable to use a temperature at least 20° C above the fiber stick temperature. As shown in the Examples when a temperature on the order of 220° C is used for those compositions the time of heat treatment may be less than ten seconds.

My new method is also illustrated in the following Examples (in which all parts are by weight):

The following Example 1 shows a preferred method for producing a filament for use as a starting material in carrying out the method of this invention.

EXAMPLE 1

Approximately 120 parts of a 2,000 molecular weight polyester glycol comprising the reaction production of a 9/1 molar mixture of ethylene glycol and propylene glycol with adipic acid was reacted with 28 parts of methylene-bis (4-phenylisocyanate) and 1.6 parts of tolylyne diisocyanate at a temperature of 90° C for 60 minutes to form an isocyanate-terminated urethane prepolymer.

The above prepolymer was diluted with 49 parts of DMF and slowly added to a rapidly agitated solution comprising 1860 parts of dimethyl formamide (DMF), 2.4 parts of methyl-imino-bis-propyl-amine, 9.4 parts of ethylene diamine and 1.0 parts of diethanolamine until a viscosity of 120 poises was attained.

After the addition of pigments and antioxidants, the above solution was extruded through a spinneratte containing 60 holes, each hole having a diameter of 0.0065 inches, into a bath containing 20% DMF in water. The resulting filaments were continuously removed from this bath and extracted countercurrently in a series of ten extraction baths. The wet filaments were then throughly dried by passage through a three-pass dryer (at a residence time of 40 seconds in each pass, the first pass being at 150° C, the second at 175° C and the last at 200° C). A textile lubricant was added to the filaments, and they were subsequently taken up on a winder.

The following Examples 2 through 7 illustrate the method of this invention.

EXAMPLE 2

A spandex filament, produced according to the process of Example 1, which had a nominal denier of 420 (417 actual), an elongation of 660% and a modulus (stress) at 300% elongation of 0.296 gram per denier and had a "fiber stick temperature" of 178° C, was passed through an apparatus functioning in the manner of the apparatus shown in FIG. 1. The single filament was taken off a feed package by means of a drive roll, passed through a comb guide and then through an additional set of drive rolls. The speeds of the first drive roll and the second set of drive rolls were adjusted to produce an elongation in the filament of approximately 3.5 times. The filament was then passed ten times in contact with about one-quarter of the surface of a heated 6 inch roll. The temperature to which the filament was exposed was approximately 225° C for a time of 2.6 seconds. The filament was then taken up on a takeup roll operating at a surface speed of 90 feet per minute. The resulting filament was 118 denier, had an elongation of 690% and a 300% modulus of 0.351 gram per denier. The filament from that drawing operation was then subjected to an identical treatment to produce a filament of 34 denier, an elongation of 720% and a 300% modulus of 0.355 gram per denier.

EXAMPLE 3

A 140 spandex filament was produced by the process of Example 1, but using as a polyester component a glycol comprising the reaction product of a 50/15/35 molar mixture of hexanediol, butanediol, and neopentyl glycol with adipic acid in a ratio to give a molecular weight of about 1800. This filament was drawn and treated by a procedure identical to that of Example 2 except that the temperature to which the filament was subjected was approximately 220° C, the filament was elongated approximately two times and it was passed over the heating roll 30 times, giving a residence time of heat treatment of slightly under eight seconds. The properties of the initial filament were denier 158; elongation 576%; a tenacity of 0.9 gram per denier and a 300% modulus of 0.236 gram per denier and had a "fiber stick temperature" of 182° C. The drawn filament had a denier of 78; an elongation of 635%; a tenacity of 0.9 gram per denier and a 300% modulus of 0.229 gram per denier.

EXAMPLE 4

A 420 denier commercially available wet-spun spandex (sold under the name "Unel" by Union Carbide Corp.) was treated in the manner of Example 2 by elongating the filament about 3.5 times and passing it 30 times over a 6 inch roll at a temperature of about 220° C, (giving a heat treatment residence time the same as that of the preceding Example). The filament prior to treatment was 437 denier, and had an elongation of 618% and a 300% modulus of 0.223 gram per denier and a "fiber stick temperature" of 176° C. The drawn filament was 126 denier and had an elongation of 530% and a 300% modulus of 0.372 gram per denier.

EXAMPLE 5

A 70 denier (nominal) spandex filament having the composition set forth in Example 1 and produced in accordance with the procedure of that Example was treated according to the procedure of Example 2. The filament was elongated approximately 3.5 times and passed 20 times over a 6 inch roll (a residence time of about 5 seconds) at a temperature of about 225° C. The filament before drawing had a denier of 68, an elongation of 618% and a 300% modulus of 0.338 gram per denier and had a "fiber stick temperature" of 178° C. The drawn filament was 19.5 denier with an elongation of 595% and a 300% modulus of 0.404 gram per denier.

EXAMPLE 6

Commercially available chemical spun 70 denier (nominal) spandex sold as "Cleerspan" by Globe Rubber Company and having properties of 68.5 denier, 720% elongation and a 300% modulus of 0.176 gram per denier (a "fiber stick temperature" of 175° C) was treated by the identical procedure of the preceding Example 5. The resulting filament was 24.5 denier, had an elongation of 280% and a tenacity of 0.705 gram per denier.

EXAMPLE 7

A commercially available spandex of 420 denier (nominal) sold as "Lycra" Type 124 by E. I. du Pont de Nemours & Co. was treated according to the method of the preceding Examples. The filament had a denier of 444, an elongation of 616%, a 300% modulus of 0.28 gram per denier, a tenacity of 0.9 gram per denier and a "fiber stick temperature" of 186° C. Following the procedure of Example 2 the filament was elongated approximately 3 times and passed 40 times over a 6 inch roll (a residence time of about 10 seconds) at a temperature of about 220° C. The filament after drawing had a denier of 154, an elongation of 580%, a 300% modulus of 0.36 gram per denier and a tenacity of 1.0 gram per denier.

1. The method of reducing the denier of a dry, finished filament formed from a substantially linear polyurethane, said polyurethane being produced by chain extension of a prepolymer with a chain extender selected from the class of hydrazine and diamines, without substantially affecting the other physical properties of the filament, comprising elongating the filament a number of times its original length and heating it to a temperature above its "fiber stick temperature" for a sufficient time so that the filament substantially permanently retains that elongation and does not recover any substantial amount of the length to which it has been elongated.

2. The method of claim 1 wherein the filament has been produced by wet spinning and said chain extender is ethylene diamine.

3. The method of claim 2 wherein the time of heating is less then ten seconds.

4. The method of claim 2 wherein the elongation of the filament does not exceed about two times its original length.

5. The method of claim 1 wherein the heating is carried out by use of heated cans.

6. The method of claim 2 wherein the filament is elongated prior to said heating.

7. The method of claim 1 wherein the filament is elongated and heated a number of times and said elongation and heating are done at the same time.

* * * * *